US005666445A

United States Patent [19]

Conrad et al.

[11] Patent Number: 5,666,445

[45] Date of Patent: Sep. 9, 1997

[54] EASY OPENING FLEXIBLE PLASTIC BAG AND A METHOD OF MAKING SAME

[76] Inventors: Daniel J. Conrad; Mark A. Roland, both of c/o Paramount Packaging Corporation, P.O. Box 902, 202 Oak Avenue, Chalfont, Pa. 18914

[21] Appl. No.: 261,241

[22] Filed: Jun. 14, 1994

Related U.S. Application Data

[63] Continuation of Ser. No. 842,637, Feb. 27, 1992, abandoned.

[51] Int. Cl.[6] ..... B65D 30/20; B65D 33/10

[52] U.S. Cl. ..... 383/207; 206/494; 383/21; 383/25; 383/66; 383/209

[58] Field of Search ..... 206/494; 383/64, 383/209, 21, 207, 208, 25, 29

[56] References Cited

U.S. PATENT DOCUMENTS

| | | | |
|---|---|---|---|
| 2,137,398 | 11/1938 | Helber | 206/57 |
| 2,448,819 | 9/1948 | Mitchell | 206/57 |
| 2,998,911 | 9/1961 | Hahn et al. | 229/66 |
| 3,012,692 | 12/1961 | Petersen | 221/63 |
| 3,161,336 | 12/1964 | Loescher | 225/106 |
| 3,172,563 | 3/1965 | Harwood | 221/48 |
| 3,227,359 | 1/1966 | Hanlon | 229/66 |
| 3,399,820 | 9/1968 | Foster et al. | 229/37 |
| 4,460,088 | 7/1984 | Rugenstein et al. | 206/494 |
| 4,573,203 | 2/1986 | Peppiatt | 383/29 |
| 4,934,535 | 6/1990 | Muckenfuhs et al. | 206/610 |
| 4,966,286 | 10/1990 | Muckenfus | 206/610 |
| 5,036,978 | 8/1991 | Frank et al. | 206/494 |
| 5,050,742 | 9/1991 | Muckenfuhs | 206/610 |
| 5,054,619 | 10/1991 | Muckenfuhs | 206/610 |
| 5,080,497 | 1/1992 | Peppiatt | 383/21 |
| 5,112,138 | 5/1992 | Peppiatt | 383/21 |

FOREIGN PATENT DOCUMENTS

| | | |
|---|---|---|
| 0223262 | 5/1987 | European Pat. Off. . |
| 0258573 | 3/1988 | European Pat. Off. . |
| 0349050 | 1/1990 | European Pat. Off. . |
| 3642327 | 2/1988 | Germany . |
| 8915566 | 11/1990 | Germany . |
| 9105943 | 8/1991 | Germany . |
| 9109154 | 10/1991 | Germany . |
| 91/08962 | 6/1991 | WIPO . |

*Primary Examiner*—Stephen P. Garbe

[57] ABSTRACT

An easy opening plastic bag includes a plastic front panel, a plastic rear panel, and plastic left and right end panels coupled to the front and rear panels. A plastic gusset is formed at the top of the bag and is joined to the front, rear, left, and right panels. A first frangible portion is disposed near a top of the front panel, and a second frangible portion is disposed near a top of the rear panel. The first and second frangible portions lie in a plane which allows a portion of the bag to rotate away from the remainder of the bag about an axis parallel to the plane. A third frangible portion is provided in the bag and extends substantially perpendicular to the plane of the first and second frangible portions.

22 Claims, 9 Drawing Sheets

EASY OPENING FLEXIBLE PLASTIC BAG AND A METHOD OF MAKING SAME

This application is a continuation of application Ser. No. 07/842,637 filed Feb. 27, 1992, now abandoned.

FIELD OF THE INVENTION

The present invention relates to an easy opening flexible plastic bag especially capable of holding highly compressed products, such as disposable diapers, and capable of being manufactured at high-speed by automated machinery. The present invention also relates to a method for making such a bag.

BACKGROUND OF THE INVENTION

Flexible plastic bags are known in the art for carrying flexible articles such as disposable diapers, incontinent briefs, and catamenial pads. These flexible articles may be compressed while being inserted into the plastic bag so that transportation, storing, marketing, and consumption of the product are more convenient. However, opening plastic bags containing such compressed articles can be quite difficult. The greater the amount of compression, the stronger the bag must be, and hence the more difficult the bag is to open. Parents are familiar with the difficult experience of controlling a wiggling infant with one hand while attempting to open a bag of diapers with the other hand. Several diaper bags have been produced which include lines of perforations therein so that the bag can be easily opened. Incorporating perforations in such a bag, however, is disadvantageous where the articles within the bag are highly compressed, i.e., compressed in thickness 25%, or preferably 50% or more, relative to their initial uncompressed thickness. A plastic bag with perforations containing such highly compressed articles may burst open if dropped during transportation or if exposed to rough handling. Therefore, what is needed is a plastic bag which is easy to open yet strong enough to contain flexible articles, preferably compressed articles, and most preferably highly compressed articles.

In FIG. 1, a flexible plastic bag containing compressed disposable diapers exerts a force in the direction of arrow A since this is the compression direction of the diapers. Compressive forces are usually applied perpendicular to the planes into which articles are folded. The force A creates a circumferential force in the bag plastic around the outside of the bag. Therefore, perforations or areas of weakened plastic which are disposed perpendicular to the circumferential force tend to weaken the bag, and the bag will tend to burst open if the circumferential forces are greater than the resistive forces in the plastic. U.S. Pat. No. 4,934,535 describes a diaper bag which exposes this problem. This patent discloses a side-opening mechanism in which a portion of the side panel and a portion of the top gusset are torn away along oval-shaped perforation lines. These bags, however, may be subject to bursting because 75 percent of the side panel is surrounded by perforations substantially perpendicular to the direction of the circumferential forces and the side panel is therefore in a weakened state.

U.S. Pat. No. 5,036,978 also relates to an opening device for flexible plastic bags wherein a large portion of the side panel is surrounded by lines of perforations. Again, such bags may be subject to bursting during transportation.

German Patent G 89 15 566.1 relates to a tubular plastic bag in which a tear strip is formed at the top of the bag along three sides thereof. After the tear strip has been removed, the bag top may be rotated upward around the still-affixed side, much like a box lid. If used with compressed articles, however, this structure does nothing to release any of the compression forces, and consequently removing compressed articles from such a bag would be quite difficult.

International Patent Publication No. WO 91/08962 also relates to a flexible plastic bag with an opening feature in the side panel. FIGS. 1 and 2 indicate that a large portion of the side panel may be rotated upward about the bag top to allow the flexible articles to protrude through the resultant side opening. This is somewhat similar to the bag disclosed in U.S. Pat. No. 4,934,535 discussed above, and may be subject to bursting.

German Patent G 91 05 943.7 pertains to a flexible plastic bag having an opening feature extending from the front panel across the side panel to the rear panel. In FIG. 1, a tear-open tongue 7 extends around the end of the bag and is started with a flap handle 11. This bag disposes the lines of perforations parallel to the direction of the circumferential forces, but introduces an inherent weakness at the flap handle 11. Flap handle 11 may catch on other structure during handling allowing the bag to open prematurely. In addition, very little of the compression force is released upon opening of this bag, and removing compressed articles therefrom would be difficult.

German Patent G 91 09 154.3 relates to a flexible plastic bag having lines of perforations extending from the front panel, across the top gusset and to the rear panel. These lines of perforations, however, are close together and extend orthogonal to the direction of the circumferential forces. This could result in bursting of the bag. In addition, although FIG. 2 of this German Patent document relates to a flexible plastic bag including a loop handle, there are no perforations in the loop handle. This would make opening such a bag difficult, and would make removing products from such a bag very difficult.

Thus, what is needed is a flexible plastic bag which is easy to open, preferably capable of containing compressed or highly compressed articles, yet is easy to manufacture with high-speed automated machinery.

SUMMARY OF THE INVENTION

The present invention reduces the above-discussed problems of the prior art and provides a flexible plastic bag which is easy to manufacture and easy to use. According to one aspect of the present invention, an easy opening plastic bag includes a front panel, a rear panel, and left and right end panels coupled to the front and rear panels. A gusset is formed at the top of the bag and is coupled to the four panels. A first frangible portion (which may be one or more lines of perforations) is disposed near a top of the front panel. A second frangible portion is disposed near the top of the rear panel, the first and second frangible portions defining a plane. The first and second frangible portions, in combination with a third frangible portion in or near the side panel, allow a portion of the bag to rotate away from the remainder of the bag about an axis which is parallel to the plane of the first and second frangible portions. The third frangible portion is disposed in the bag and includes a portion that extends substantially perpendicular to the plane of the first and second frangible portions. By having frangible portions extending as described, the bag is easy to open yet successfully tends to resist high compression forces.

According to another aspect of the present invention, an easy opening plastic bag includes front and rear panels, and left and right end panels joined to the front and rear panels. A gusset is disposed on top of the bag and joined to the four panels. A V-shaped seal is provided in each of the left and right end panels, each V-shaped seal extending from the two upper corners of a respective end panel to an apex at a middle portion of the respective end panel. Each V-shaped seal attaches together the gusset and the respective left and right end panels. This V-shaped seal prevents compressed products from entering the triangular-shaped space between the gusset and the left and right end panels. A first line of perforations is disposed in the front panel and extends to the left end panel. A second line of perforations is disposed in the rear panel and also extends to the left end panel. A third line of perforations is disposed in the left end panel and connects the first and second lines of perforations to allow a portion of the gusset to rotate upward away from the left end panel. Preferably, the third line of perforations has a portion thereof disposed below the apex of the V-shaped seal.

According to an additional aspect of the present invention, a plastic bag includes plastic front and rear panels, plastic left and right end panels joined to the front and rear panels, and a gusset disposed between the front, rear, left end, and right end panels. In at least one of the end panels, a pattern of frangible portions is disposed comprising three arrays of frangible portions connected to each other, each of two such arrays extending to and connecting with one of fourth and fifth arrays of frangible portions. One of such fourth and fifth additional arrays is located in the front panel and the other of such additional arrays is located in the rear panel.

According to a further aspect of the present invention, the above-described flexible plastic bag may include a line or lines of perforations disposed in the left-end panel and extending from the third line of perforations toward the bottom of the bag.

According to yet another aspect of the present invention, an easy opening plastic bag includes front and rear plastic panels, left and right plastic panels joined to the front and rear panels, and a plastic gusset disposed at a top of the bag and joined to the four panels. A frangible plastic portion is provided in the left end panel extending from a top corner of the front panel toward a center portion of the left panel and then to a bottom corner of the front panel. Preferably, this frangible plastic portion is a semicircular-shaped line of perforations.

According to yet a further aspect of the present invention, an easy-opening flexible plastic bag includes front and rear plastic panels, left and right plastic panels joined to the front and rear panels, and a plastic gusset disposed at a top of the bag and joined to the other four panels. A plastic loop handle is joined to the front and rear panels and bridges the gusset. A first frangible portion is disposed in the handle and extends from the front panel to the rear panel. A second frangible portion is disposed in the gusset and extends from the front panel to the rear panel and is connected to the first frangible portion. A third frangible portion is disposed in the front panel and is connected to the first and second frangible portions. A fourth frangible portion is disposed in the rear panel and is also connected to the first and second frangible portions. With this structure, the user rips the handle apart in the middle thereof and then continues to rip along the lines of perforations to separate portions of the gusset and the front and rear panels. Then, the separated portion may be easily rotated upward and away from the remainder of the bag to provide a convenient opening in a center of the bag.

The present invention also solves problems of manufacturing such an easy opening bag. According to one aspect of the present invention, a method of manufacturing an easy opening plastic bag includes the steps of (1) folding a first plastic sheet over on itself to form a front panel and a rear panel, (2) making an interior fold at the folded portion of the first plastic sheet to form a gusset between the front and rear panels, (3) folding a second plastic sheet over on itself and positioning the second plastic sheet adjacent the front and rear panels of the first plastic sheet and bridging the gusset, (4) forming first and second frangible portions in the front and rear panels so as to define a plane including the first and second frangible portions, (5) forming a third frangible portion in the bag extending substantially perpendicular to the plane, (6) sealing left and right side edges of the bag, and (7) trimming and sealing the second flexible sheet to provide a loop handle coupled to the front and rear panels.

These and further aspects of the present invention will become apparent from the following detailed description of the preferred embodiments taken together with the drawings.

BRIEF DESCRIPTION OF THE DRAWINGS

For purposes of illustrating the invention, the drawings show preferred forms, but this invention is not limited to the precise arrangements and instrumentalities pictured or described below.

DETAILED DESCRIPTION OF THE PREFERRED EMBODIMENTS

An easy opening flexible plastic bag according to the present invention may be manufactured by automated high-speed machinery from extended sheets of flexible thermal plastic. A plurality of such bags are manufactured and shipped to a user who will insert product into the bag, seal the bag, and introduce the product into normal channels of commerce. Each bag will, when filled, assume a substantially cubic or parallelepiped-shape. The bags according to the present invention, by the careful location of lines of perforations in the bag, will allow the manufacturer to pack a large quantity of highly compressed articles therein without the bag bursting open. The bags according to the present invention also offer the consumer a bag which may be easily opened and from which products may be easily extracted. Further, it is preferable for the bags according to the present invention to have a plastic loop handle since it is known that consumers desire such a feature to ease their purchase, transportation, and use of the bag.

Although the preferred form of material for the flexible plastic bag is thermoplastic polymeric material, those of skill in this field will readily understand that alternative materials may be used, such as treated or untreated paper, composites, rubberized products, etc. The term "plastic" used in the specification and claims is intended to encompass all such equivalent materials.

Figure 1:
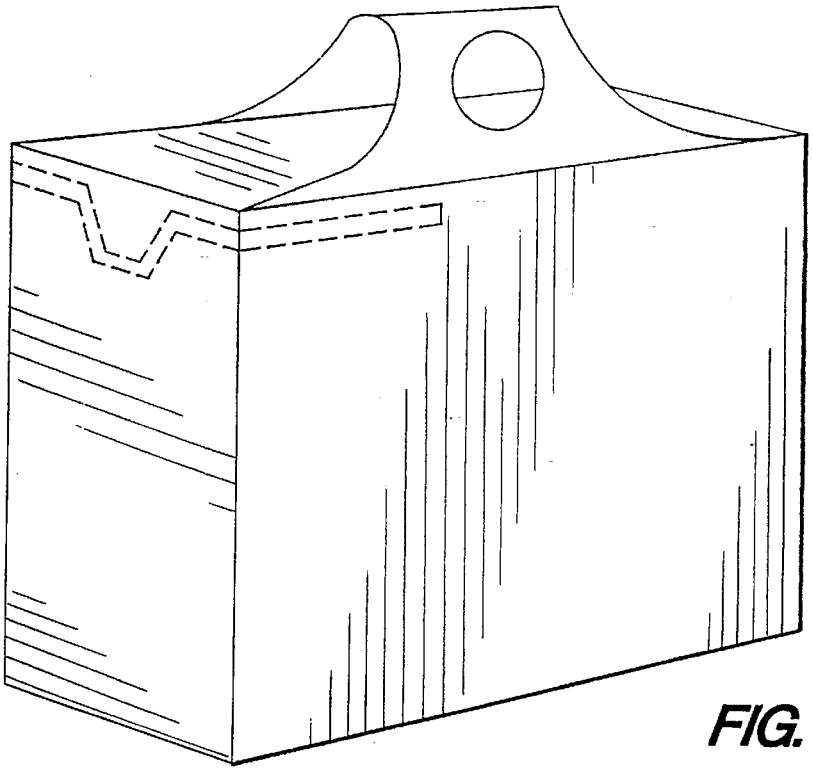
FIG. 1 is a perspective view of a first embodiment of the present invention.

FIG. 1 is a perspective view of a first embodiment of the present invention wherein flexible plastic bag 10 includes a front panel 12, a rear panel 14, a left end panel 16, and a right end panel 18. Each of the end panels includes a seam 20 which is formed during the manufacturing process to be described below. A gusset 22 is formed at the top of bag 10 and joins together the panels 12, 14, 16 and 18. A plastic loop handle 24 is joined to both the front panel 12 and the rear panel 14, and bridges the gusset 22. Preferably, a hand-grip opening 26 is formed in handle 24. U.S. Pat. No. 4,573,203 is an example of this kind of bag.

At or near the top of front panel 12, a first frangible portion 30 is provided extending from approximately the middle of the front panel 12 to the left end panel 16. The frangible portion 30 may comprise parallel lines of perforations 31 and 32, as shown in FIG. 1. However, the frangible portion may also comprise a weakened section of plastic, a printed or dotted line to indicate an area to be cut or torn, a tear strip of different or additional material formed in the panel, or any other equivalent manner of providing for separation of the panel at the area shown. It may be preferred for the frangible portion 30 to comprise a single line of perforations so that no extraneous strips of plastic are left over to present a danger to children or animals.

A second frangible portion 34 is disposed in the rear panel so that the corresponding lines of perforations in the front and rear panels lie in substantially the same plane (e.g., a horizontal plane in FIG. 1) as first frangible portion 30.

A third frangible portion 36 is disposed in the left end panel and connects together the first and second frangible portions 30 and 34. The third frangible portion 36 has horizontally-extending portions 38 and a notch-shaped portion 39. The notch-shaped portion 39 includes downward-extending frangible sections 40 which, when viewed from a direction orthogonal to front panel 12 or from a direction orthogonal to left end panel 16, extends substantially perpendicular to the plane which includes the first and second frangible portions 30 and 34. Therefore, when the bag is opened along the frangible portions 30, 34, and 36 (See FIG. 2), openings are made in directions perpendicular to each other in order to ease the opening process and to release more of the compression forces of the compressed articles, allowing the articles to be more easily extracted from the bag. Note that the direction and disposition of the frangible portions 30, 34, and 36 have a reduced, preferably a practical minimum, extent of frangible portions (for example, a number of perforations) orthogonal to the direction of the circumferential forces, and thus do not significantly increase the tendency of the bag to burst during transportation.

The bag of FIG. 1 also includes V-shaped seals 42 and 44 extending from respective top corners of the bag toward an apex 46 located on or adjacent seam 20 in a middle portion of the left end panel 16. These V-shaped seals are made during bag manufacture in order to seal off the triangular-shaped space which is formed from surplus plastic between the end panel 16 and the gusset 22. The V-shaped seals will prevent highly compressed articles from entering the triangular-shaped space and distorting the bag's shape.

It is preferable that the bottom portion of the notch-shaped frangible section 40 be disposed at or below the apex 46 of the V-shaped seal. This way, the reinforced area of plastic around apex 46 and/or the V-shaped seals 42 and 44 will assist in opening the bag along the lines of perforations since the reinforced area of plastic will be stronger than the adjacent perforated areas of plastic. Thus, the apex 46 may be used as a "tab" in order to initiate or assist in the opening of the notch-shaped frangible portion 39 in the end panel 16. In addition, it may be beneficial for the frangible portion 36 in end panel 16 to be disposed adjacent to or on both sides of the V-shaped seal, as will be discussed later with respect to the embodiment of FIG. 12.

Figure 2:
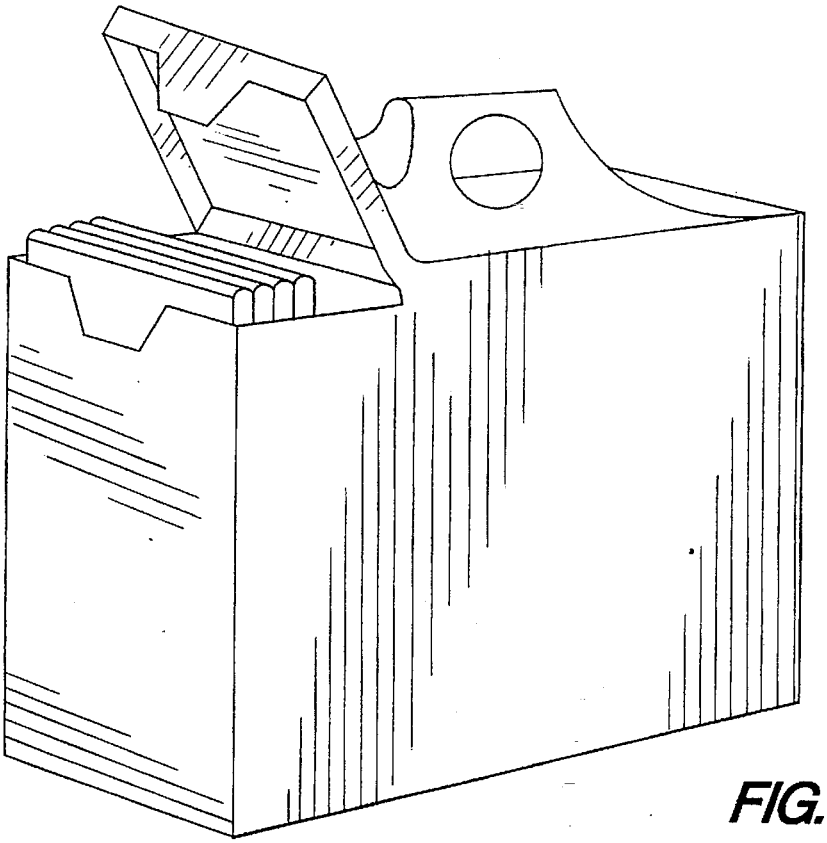
FIG. 2 is a perspective view showing the FIG. 1 bag opened.

FIG. 2 is a perspective view of the FIG. 1 embodiment showing a portion of the gusset 22 rotated upward about an away from the end panel 16. The space where the notch-shaped portion 40 is pulled away from end panel 16 provides a convenient means for the user to grasp the articles within the bag. This also assists in releasing some of the compression forces to allow easier extraction of articles from the bag.

Figure 3:
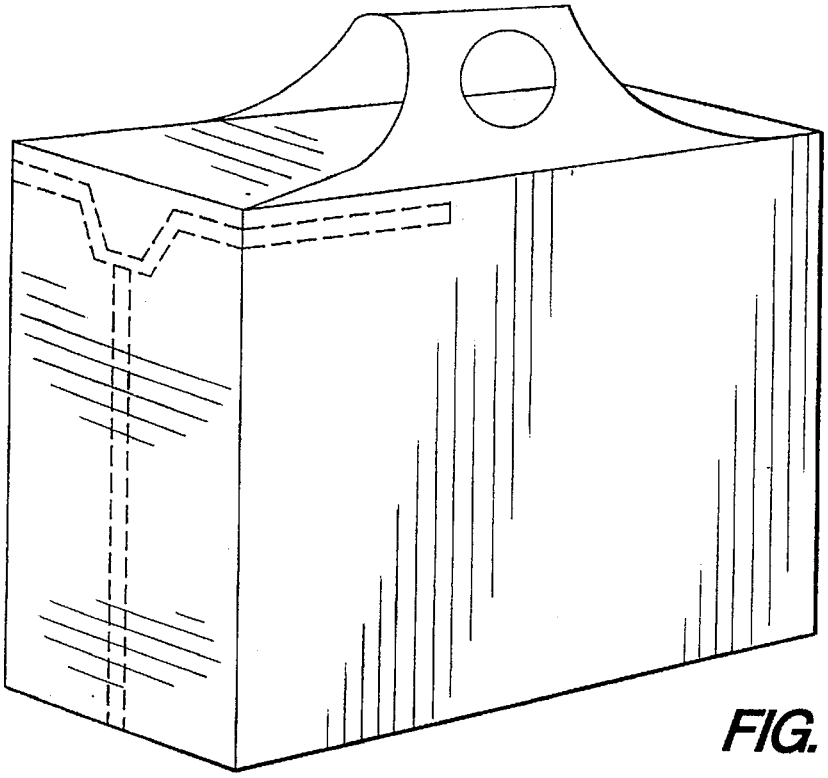
FIG. 3 is a perspective view of a second embodiment of the present invention.

In FIG. 3, a perspective view of a second embodiment according to the present invention is provided, and structures which are similar to FIG. 1 structures are indicated by the same reference numerals. Some reference numerals, however, have been omitted for purposes of clarity. In FIG. 3, a fourth frangible portion 50 is disposed in the end panel 16 and extends from the bottom of notch-shaped frangible portion 39 to substantially the bottom of the bag. The frangible portion 50 may be stronger than the other frangible portions. The frangible portion 50 preferably includes parallel lines of perforations 51 and 52 spaced closely together. The lines of perforations 51 and 52 may extend on either side of the seam 20 (not shown), so that the enhanced structural strength of seam 20 will help in separating the frangible portion 50 along lines of perforations 51 and 52. This structure allows the user to release a selected portion or substantially all of the compression forces within the bag by activating the first through third frangible portions and a user-selected portion of the fourth frangible portion.

Figure 4:
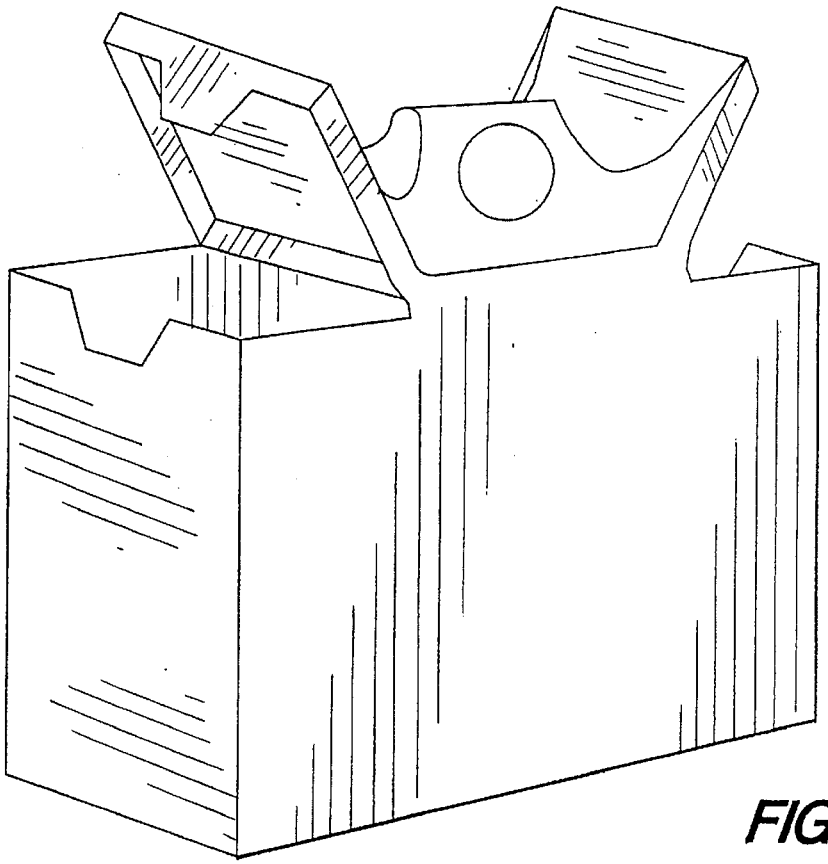
FIG. 4 is a perspective view of a third embodiment of the present invention.

FIG. 4 is a perspective view showing a third embodiment of the present invention wherein an opening is provided at the top of each of the end panels 16 and 18. Thus, a frangible portion 30' is provided in front panel 12, a frangible portion 34' is provided in rear panel 14, a frangible portion 36' is provided in end panel 18, and the frangible portion 36' includes a notch-shaped frangible portion 39'. This structure allows easy access to selectable portions of the bag where, for example, the bag contains two separate sections divided by vertical plastic walls (not shown).

Figure 5:
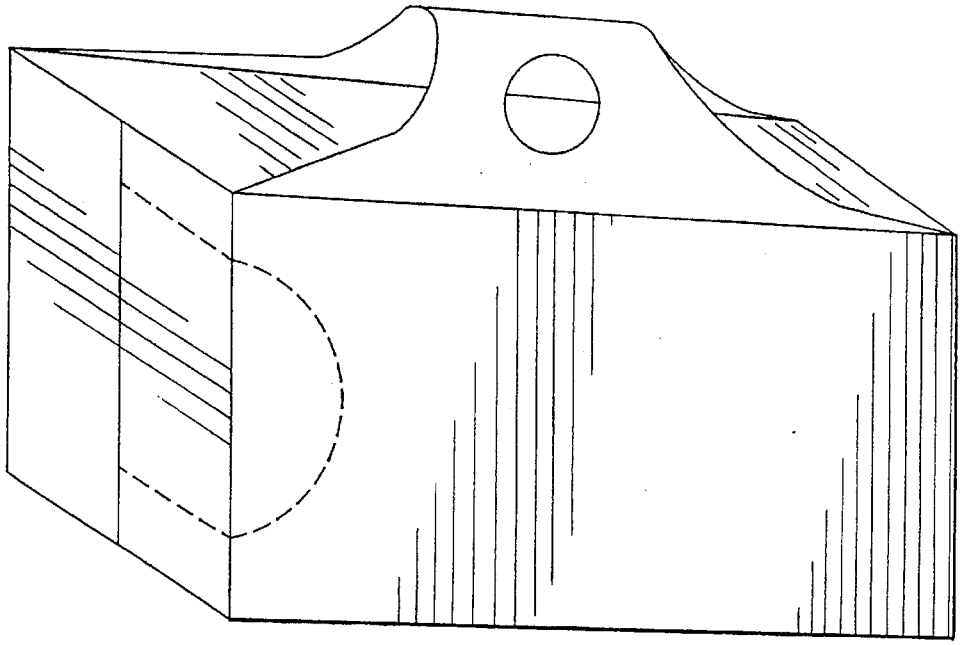
FIG. 5 is a perspective view of a fourth embodiment of the present invention.

FIG. 5 is a perspective view of a fourth embodiment according to the present invention, like reference numerals representing like structures of FIG. 1. The embodiment of FIG. 5 includes a substantially semicircular frangible portion 54 disposed in the front panel 12 and extending from a top portion of the panel 12 to a bottom portion thereof. Frangible portions 55 and 56 are horizontally disposed in the end panel 16 and connect with the frangible portion 54 in the front panel 12. The portions 55 and 56 preferably extend to the seam 20 so that when the frangible portions are opened, all of the compression force is not released. However, the frangible portions 55 and 56 may extend only part of the way to seam 20, may extend through seam 20, or may extend all the way to the rear panel 14.

When the frangible portions 54, 55, and 56 are opened, the edges of the compressed articles within the bag will be exposed for easy gripping and extraction from the bag. Since the products will be extracted in a direction parallel to the compression forces, friction between the articles will not be a substantial factor in removing the articles from the bag. Also, since the shape of the frangible portion 54 is substantially semicircular, a reduced number, preferably a minimum number, of perforations is disposed perpendicular to the direction of the circumferential forces, and thus orientation and arrangement reduces stress at the perforations and tends to minimize bursting stresses. Thus, the frangible portion 54 will tend to resist bursting during transportation or handling. The frangible portion 54 will also be clearly visible to the user and thus easily activated. Finally, since the frangible portions 54, 55, and 56 are disposed in substantially the center of the bag, a large quantity of the compression forces will be released since these compression forces act more strongly in the middle of the bag and are most effectively resisted by a "belt-like" action of the middle portions of the bag. By releasing a portion of this "belt", a large quantity of the compression forces can be released without releasing all of the force so that the articles may be retained within the bag.

Figure 6:
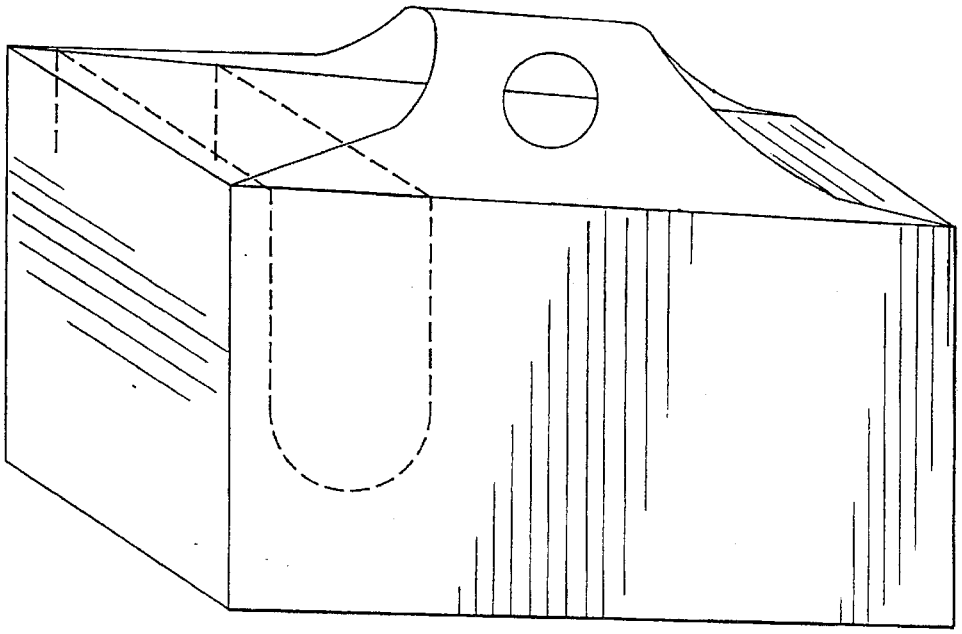
FIG. 6 is a perspective view of a fifth embodiment of the present invention.

FIG. 6 is a perspective view of a fifth embodiment according to the present invention featuring a frangible portion 60 which extends from a bottom or middle portion of front panel 12 upward across gusset 22 and down the back of rear panel 14. Again, the preferred frangible portion 60 includes lines of perforations 61 and 62 connected by a semicircular array of perforations 63 oriented and arranged to reduce stresses, as referred to above. Note also that perforations 64 and 66 are included in the skirt portion 25 of handle 24. Although the lines of perforations 61 and 62 extend perpendicular to the direction of the compression forces, the lines 61 and 62 do not traverse (e.g., extend all the way across) the entire front panel and are spaced apart by a distance sufficient (as opposed to the construction of German Patent G 91 09 154.3 previously discussed) to diminish the adverse effects of closely-spaced perforations disposed perpendicular to the compression forces.

Figure 7:
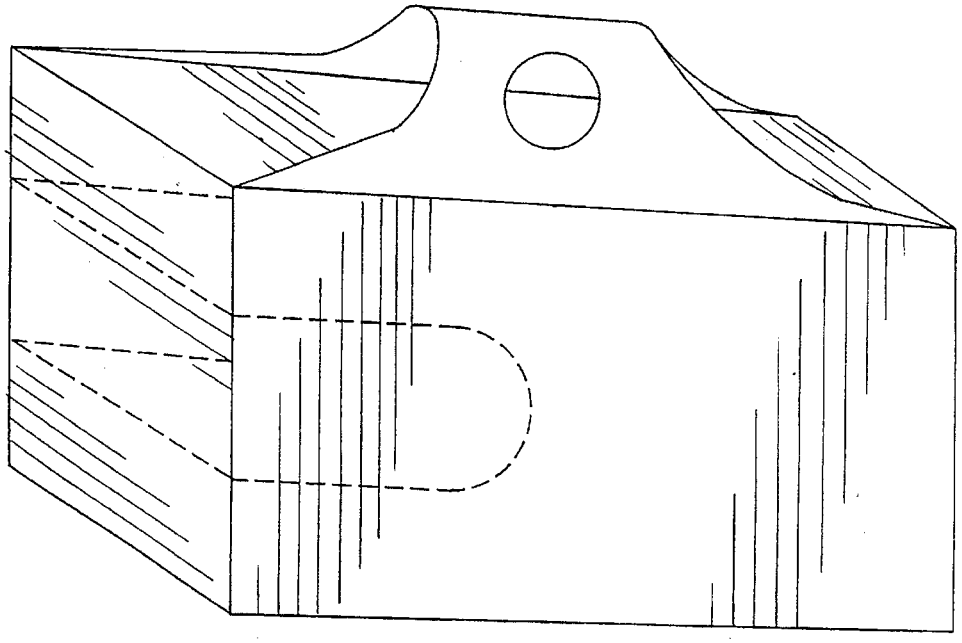
FIG. 7 is a perspective view of a sixth embodiment of the present invention.

FIG. 7 is a perspective view of a sixth embodiment according to the present invention in which frangible portion 70 extends from a middle or end section of front panel 12, across the end panel 16, and into the rear panel 14. The frangible portion 17 preferably includes lines of perforations 71 and 72 connected by a semicircular array of perforations 73. Again, since the perforations which are perpendicular to the compression forces are arranged in a semicircular array, the stresses are reduced and the risk of the bag bursting during transportation is reduced, or preferably minimized. With the structure of the frangible portion 70 so arranged, the bag is opened in a "belt-like" fashion, releasing a large portion of compression forces while retaining enough compression forces to hold articles within the bag. Also, since a portion of perforations 73 is perpendicular to the perforations 71 and 72, more of the compression forces can be released.

Figure 8:
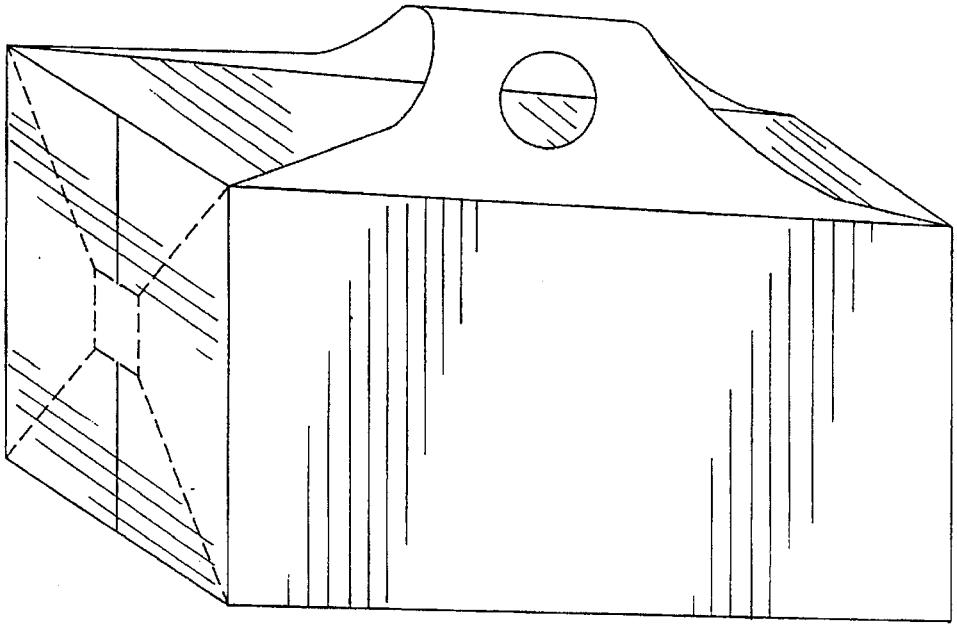
FIG. 8 is a perspective view of a seventh embodiment of the present invention.

FIG. 8 is a perspective view of a seventh embodiment according to the present invention in which various frangible portions are provided on end panel 16. In the preferred form, first and second lines of perforations 81, 82 extend from respective corners of the bag toward a middle portion of the end panel 16. A connecting set of perforations 83 connects the first and second. lines 81, 82. Note that connecting perforations 83 may comprise a single line of perforations, a square-shaped array of perforations, a semicircular array of perforations, a circular array of perforations, etc. Preferably, the connecting set of perforations 83 extends across seam 20. Furthermore, third and fourth lines of perforations 84, 85 may also be disposed in end panel 16 extending from the third and fourth corners of the bag toward the connecting set of perforations 83. This structure provides flexibility and selectability for the user who may open any combination of the four triangular-shaped portions of end panel 16. For example, the user may open only the top triangular-shaped portion, only the front triangular-shaped portion, or both of these portions, depending upon the consumer's specific desires. This embodiment features a reduced, preferably a minimum, number of perforations disposed perpendicular to the circumferential forces.

Furthermore, the portion of plastic within the connecting set of perforations 83 can act as a tab to ease the breaking-open of the frangible portions. In addition, a tab or tabs (not shown), preferably integral with the bag, may be placed at or near this location to assist in opening the bag (see discussion of tabs 120, 131, and 133 in FIG. 12 below).

Figure 9:
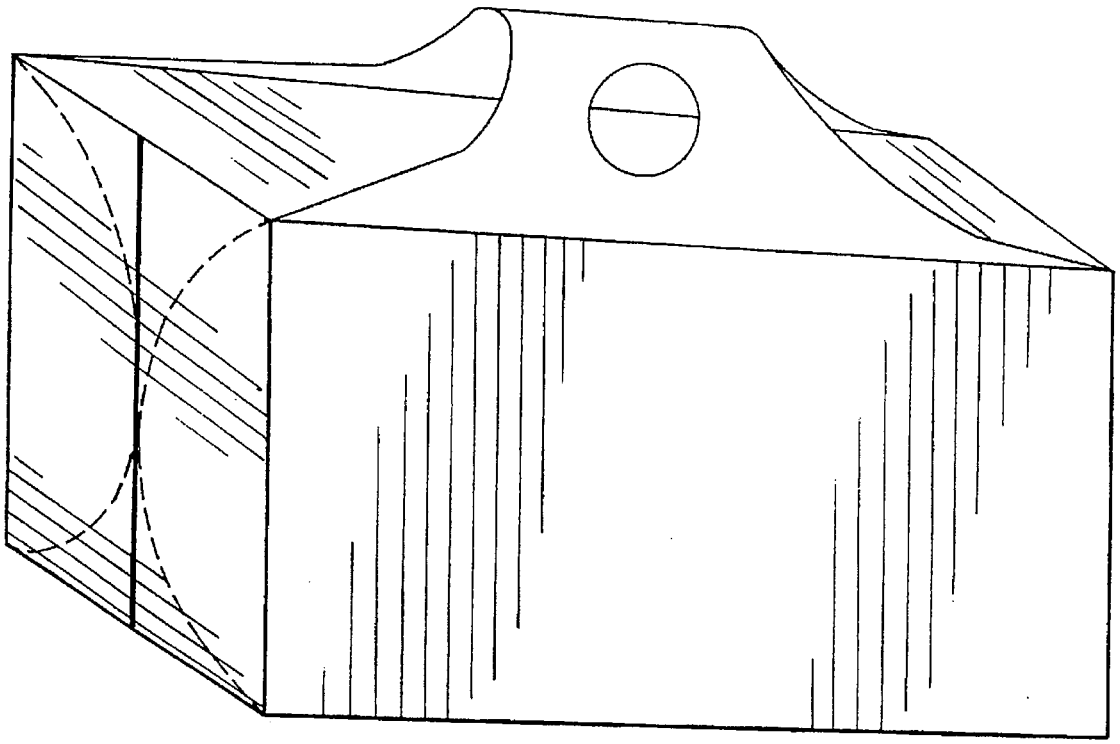
FIG. 9 is a perspective view of an eighth embodiment of the present invention.

FIG. 9 is a perspective view of an eighth embodiment according to the present invention in which a front and/or rear portion of the end panel 16 may be separated along frangible portions 91 and/or 92. For example, frangible portion 91 may comprise a curvilinear array of perforations disposed in end panel 16 and extending from a top corner of front panel 12 in toward the seam 20 and then back to the bottom of the front panel 12. The frangible portion 91 is preferably spaced apart from the seam 20 by some small distance. This will allow the bag to retain structural support from the seam 20, retaining some of the compression forces within the bag. Also, it is preferable to have a reduced number, preferably a minimum number, of perforations disposed perpendicular to the direction of the circumferential forces. Although a semicircular array of perforations is depicted in FIG. 9, the frangible portion 91 may comprise a trapezoidal shape, or a combination of linear and curvilinear shapes. The arrangement and orientation of the frangible portion should preferably tend to minimize stresses that would open the bag as a result of circumferential forces. Also, a second frangible portion 92 may be disposed on end panel 16 symmetrical to the first frangible portion 91 across seam 20. Thus, the user can open one or both of the frangible portions 91 and 92.

Figure 10:
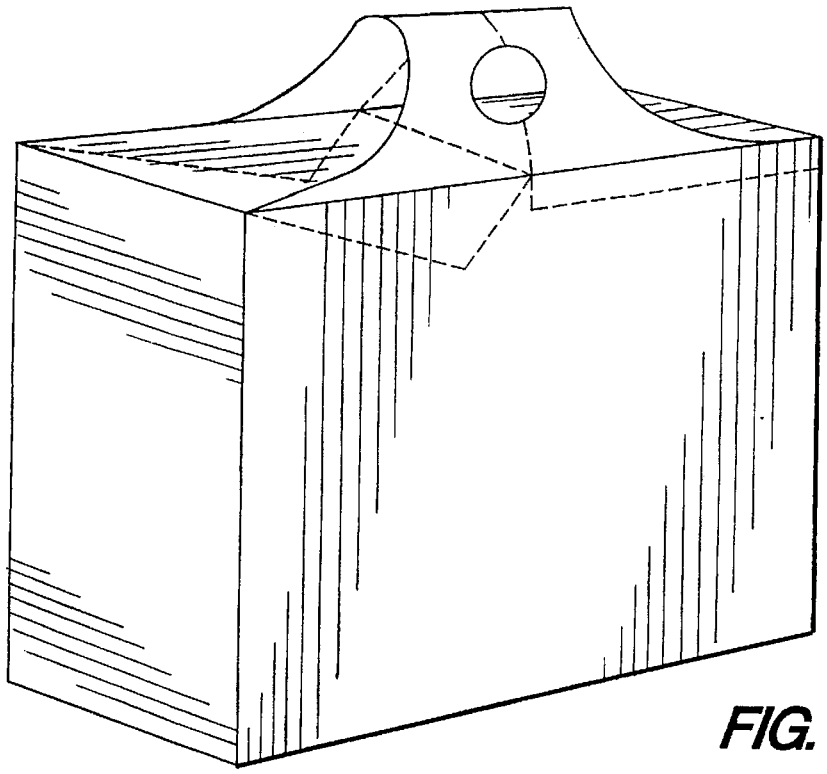
FIG. 10 is a perspective view of a ninth embodiment of the present invention.

FIG. 10 is a perspective view of a ninth embodiment according to the present invention in which the handle may be used to initiate and propagate the tearing of the bag to expose the articles contained therewithin. In detail, a first frangible portion 100 is disposed in the handle 24 and extends from the front panel 12 to the rear panel 14. The first frangible portion 100 may include a line of perforations 101 with a long slit 102 disposed in the center of the handle to allow easy initiation of the tear along the line of perforations 101. A second frangible portion 104 is disposed in the gusset and extends from the front panel 12 to the rear panel 14 and connects with the first frangible portion 100.

A third frangible portion 106 is disposed in the front panel 12 and connects to the first frangible portion 100 and the second frangible portion 104. Likewise, a fourth frangible portion 108 is disposed in the rear panel 14 and also connects to the first and second frangible portions 100, 104. In the preferred form, both frangible portions 106 and 108 extend downward from the handle toward the bottom of the bag, and then extend upward at a curvilinear or angled turning point to respective upper corners of the end panel 16, as shown in FIG. 10. This turning point formation of the frangible portions 106 and 108 tends to minimizes the amount of weakened plastic perpendicular to the compression forces. In operation, the user grips the handle 24 and begins to tear from the long slit 102 downward along the line of perforations 101. Upon reaching the front and rear panels 12 and 14, the tear will continue in the gusset 22 along the frangible portion 104 and into the front and rear panels along frangible portions 106 and 108. When the tear reaches the turning point of frangible portions 106 and 108, it will turn and rip upward toward the top corners of the end panel 16. At this point, the left portion of top gusset 22 will easily rotate upward about an axis lying on or near the top of gusset 22 in order to expose the products within the bag.

In an alternative form shown in the right portion of FIG. 10, the third and fourth frangible portions may comprise vertically and horizontally-disposed lines of perforations 110 in front panel 12, and similar lines of perforations (not shown) in rear panel 14. Note that lines of perforations 110 should be disposed relatively close to the top of the bag to minimize the amount of perforations disposed perpendicular to the compression forces.

Figure 11:
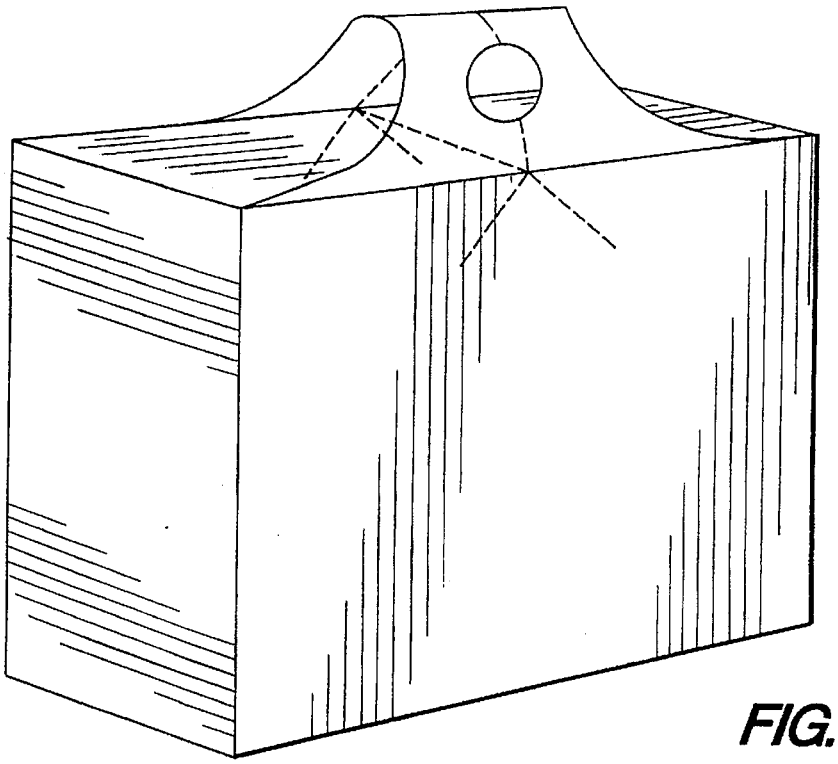
FIG. 11 is a perspective view of a tenth embodiment of the present invention.

FIG. 11 is a perspective view of a tenth embodiment according to the present invention in which a handle-opening feature similar to FIG. 10 is provided. However, the third and fourth frangible portions comprise arrays 112 and 114 which are disposed respectively in the front and rear panels 12 and 14, but extend downward toward the bottom four corners of the bag. This allows the center of the bag to be opened on both sides of the handle 26. Again, the number of perforations perpendicular to the compression forces are reduced or preferably minimized.

Figure 12:
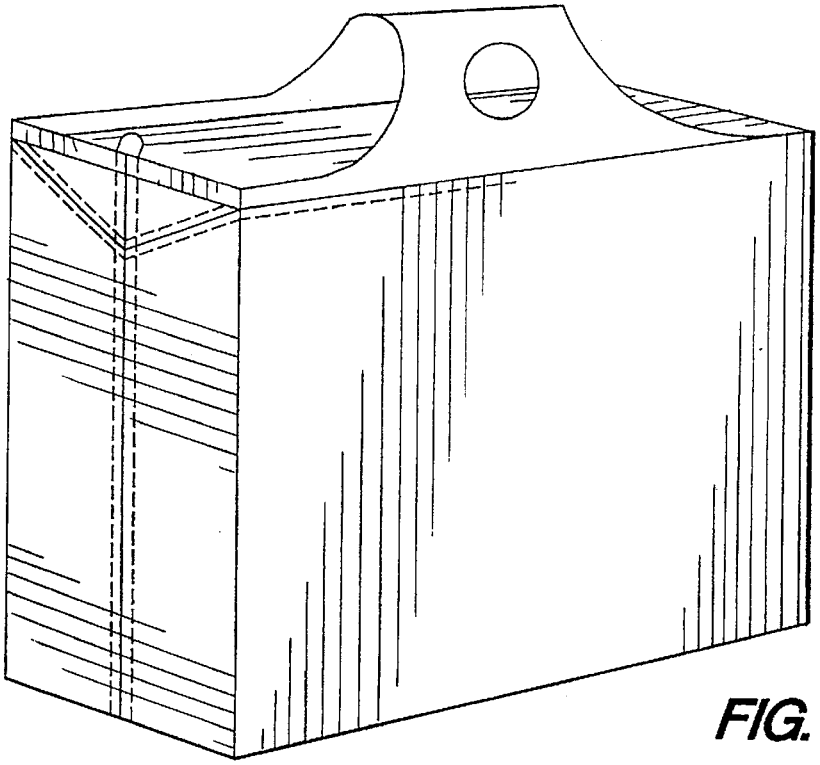
FIG. 12 is a perspective view of an eleventh embodiment of the present invention.

FIG. 12 is a perspective view of an eleventh embodiment according to the present invention in which the skirt 25 of the handle 24 extends around the top of end panel 16 and includes an upwardly-extending tab 120. A frangible portion 122 (preferably comprising lines of perforations 123 and 124) extends from the tab 120 toward the bottom of the bag. Preferably, the lines of perforations 123 and 124 are disposed astride seam 20. Again, the structural support of seam 20 will assist in separating the frangible portion 122 from the end panel 16, and these frangible portions can be made stronger than others, but they can still be broken by the user because of the added effective force caused by pulling on the seam, and preferably with a tab such as 120, 131, or 133. This embodiment may also include V-shaped seals 42 and 44 with additional frangible portions 126, 128 disposed adjacent or astride the respective V-shaped seal portions 42 and 44. The frangible portions 126 and 128 may be provided in addition to or in lieu of the frangible portion 122. Also, in an alternative form, the frangible portions 126 and 128 may respectively extend to the rear and front panels along frangible portions 130 and 132. In use, the consumer grasps tab 120 and rips downward a user-selectable distance along frangible portion 122, and/or upward along frangible portions 130 and 132. The frangible portions 126 and 128 may also be torn by either the downward or upward ripping motion.

FIG. 12 also shows alternative forms in which plastic tabs 131 and/or 133 are provided in seam 20 above, below and/or at the apex 46 of the V-shaped seal. Of course, a plastic tab may be located anywhere in the neighborhood of the apex 46. This advantageous location of a plastic tab will be easy to manufacture yet will provide a convenient hand hold for a consumer to begin opening the bag along frangible portions 122 and/or 126, 128.

Figure 13:
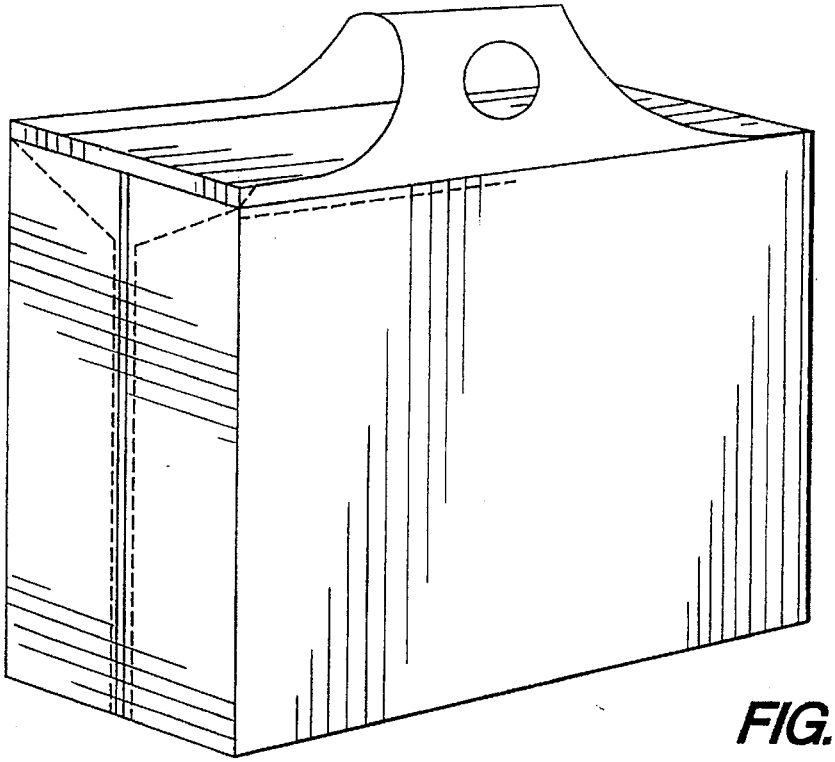
FIG. 13 is a perspective view of a twelfth embodiment of the present invention.

FIG. 13 is a perspective view of a twelfth embodiment according to the present invention in which the handle skirt 25 is not sealed to the end panel 16. This provides a convenient handle 135 for the consumer to initiate tearing downward along end panel 16, or upward along gusset 22. If the handle 135 of skirt 25 is used to tear downward along the end panel 16, perforations 134 and 136 are provided in the handle skirt 25 at the top two corners of the bag adjacent end panel 16. This handle may be combined with the V-shaped seal of FIG. 12 for advantageous results.

Figure 14:
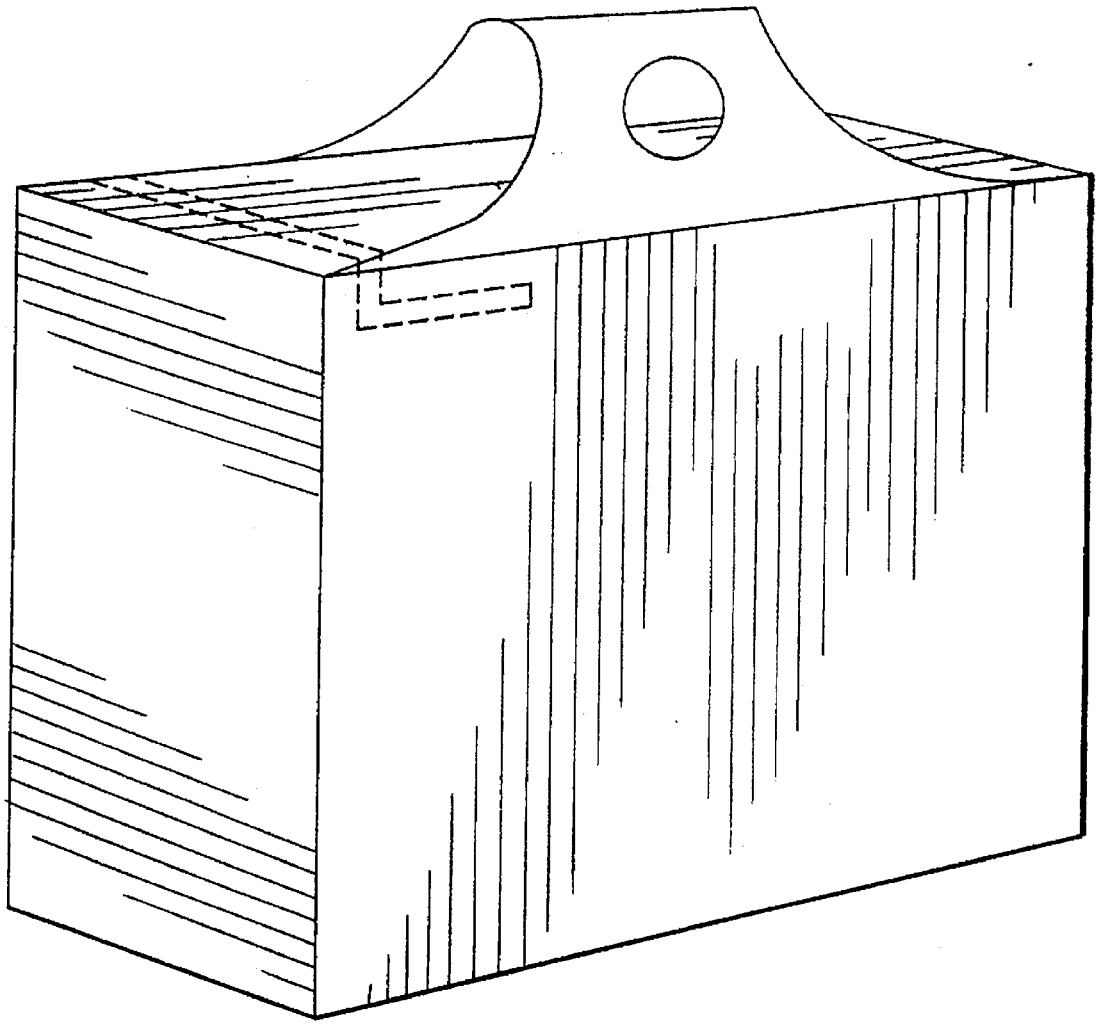
FIG. 14 is a perspective view of a thirteenth embodiment of the present invention.

FIG. 14 is a perspective view of a thirteenth embodiment according to the present invention in which a frangible portion 140 is horizontally disposed in the front panel 12 and extends upward across handle skirt 25, across gusset 22, and down the rear panel 14 to a horizontally extending section 142 in back panel 14. In this embodiment, a portion of the gusset 22 is rotated upward and away from the end panel 16. However, very little of the compression forces are released since the end panel 16 remains intact. This embodiment is useful where the product must be transported again after being initially opened.

Thus, a number of embodiments have been described which provide an easy opening flexible plastic bag which is easy to manufacture but will contain articles preferably compressed articles, and more preferably highly compressed articles, therein.

Figure 15:
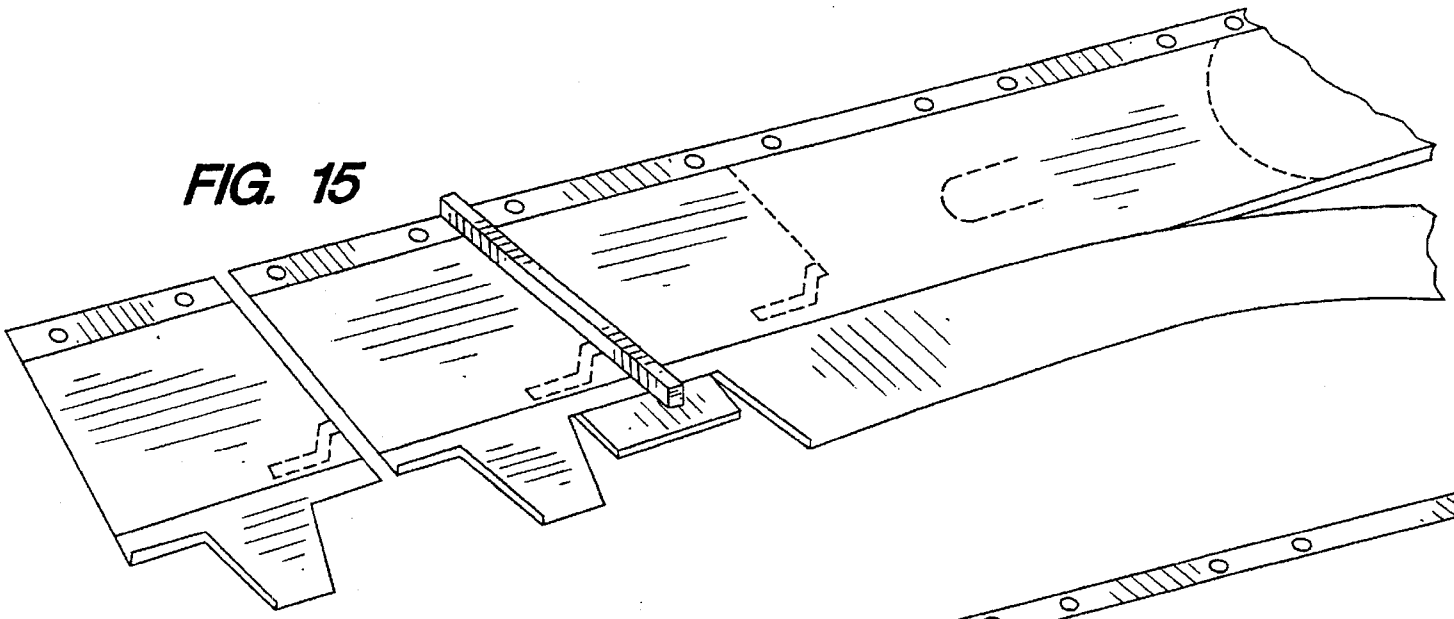
FIG. 15 is a perspective view showing a part of the process of manufacturing a plurality of bags according to different embodiments of the present invention.

The present invention is also directed to a method of making any of the bags of embodiments 1 through 13 described above. FIG. 15 depicts part of the process for manufacturing bags according to various embodiments described above. In FIG. 15, a first extended, continuous thermal plastic sheet 150 is folded over on itself along its longitudinal axis. An M-shaped fold 152 is made at the folded end, for example, as shown in U.S. Pat. No. 4,573,203. A second extended, continuous sheet of thermal plastic 154 is folded over on itself along its longitudinal axis and is positioned with respect to the first plastic sheet 150 so as to bridge the M-shaped fold 152, as exemplified in U.S. Pat. No. 4,573,207.

The thus-positioned and folded plastic sheets 150 and 154 are subjected to a continuous trimming and sealing procedure, which may be done at high-speed using automatic machinery, whereby individual bags 155, 156 are produced. Specifically, second plastic sheet 154 is affixed to first plastic sheet 150, and portions of the second plastic sheet 154 are trimmed away, e.g., with a hot wire or an appropriately shaped cutting tool, to produce the handle 24 including the grip section 26. Also, left and right side edges of the bags are trimmed and sealed by tool 158 to produce the individual bags, as will be discussed below. The tool 158 simultaneously cuts the bags and seals together the bag edges along seams 20. Thus, the structure of the bags according to FIGS. 1–14 above is particularly designed for mass production techniques where a plurality of bags are produced continuously and sequentially.

The bags 155 and 156 in FIG. 15 are bags according to the embodiment of FIG. 1, including the frangible portions 30, 34 and 36. The frangible portions may comprise an array of perforations which are formed in the first plastic sheet 150 before or after the sheet is folded over on itself. Where the perforations are symmetrical with respect to the seam 20, the perforations may be formed after the first plastic sheet 150 is folded over on itself. FIG. 15 also depicts, in an exemplary form, frangible portions 70 and 91 according to the embodiments of FIGS. 7 and 9, respectively. Those of skill in this field will readily understand that the frangible portions of all of the embodiments described above can be quickly and easily formed in the first and second plastic sheets 150, 154 by in-line techniques in the mass production process.

FIG. 15 also exhibits a blank 159 which is inserted into the M-shaped fold 152 of the first plastic sheet 150 or the open end of the bag, if required, to form different structures on different sides of the bag.

Figure 16:
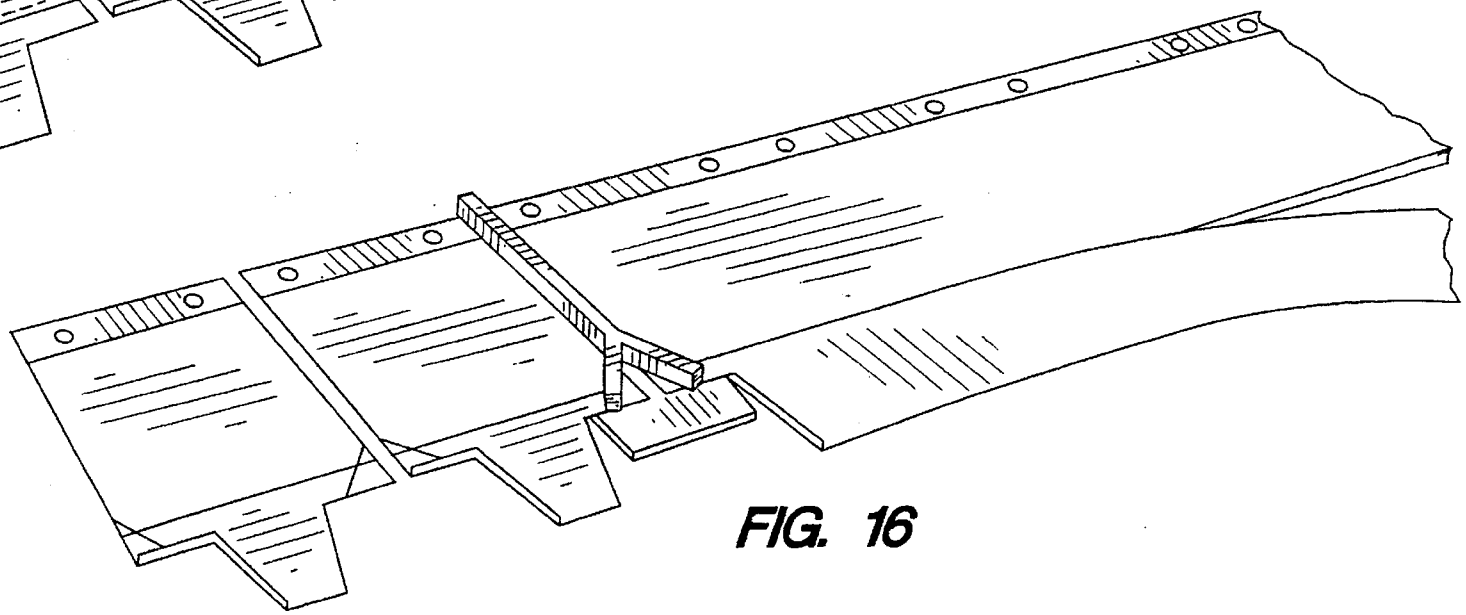
FIG. 16 is also a perspective view showing a part of the process of manufacturing a plurality of bags according to various embodiments of the present invention.

FIG. 16 depicts a portion of a process of manufacturing a plurality of plastic bags according to any of the embodiments discussed above wherein the cutting and sealing tool 158 is used in conjunction with the blank 159 to produce the V-shaped seals 42, 44, discussed above with respect to FIG. 1. As can be seen, in this embodiment, tool 158 includes Y-shaped arms 160 and 161 which cooperate with blank 159 to seal the gusset to the left and right end panels, respectively. Note that the arms 160 and 161 of tool 158 will be mirrored on a second tool (not shown) underneath blank 159 to form the V-shaped seals for the rear panel. The arms 160, 161 may be used with the tool 158 as shown or the arms may be part of another tool applied in a different process step, as is known by those skill in the field.

The cutting and sealing tool 158 may also include one or more indents 162 for the purpose of creating tabs 131 and/or 133 described above in connection with FIG. 12. The tool 158 may also include cutting sections 164 and 166 which will separate handle skirt 25 from the top of end panels in order to produce the handle 135 of FIG. 13. Tool 158 may also include a tab-shaped cutting portion 168 which may be used to produce the tab 120 depicted in FIG. 12. The person of ordinary skill in this field will readily perceive that a number of modifications and arrangements of tool 158 may produce the various plastic structures described above.

FIGS. 15 and 16 also depict wicket holes 170 which are formed at the bottom of the first sheet of plastic 150. Typically, after the individual bags 155 and 156 are formed, they are left open at the bottom so that the article manufacturer may hang the bags upside down from wicket holes 162, pack the compressed articles into the bag, and then seal the bag bottom.

Where perforations are used as the frangible portions, such perforations are typically formed in the first plastic sheet 150 by using a steel rule die driven by a pneumatic piston. When the first plastic sheet 150 is stopped for the trimming and sealing performed by tool 158, the steel rule die is driven downward and includes projections which penetrate through the front and rear panels at the same time. Thus, the lines of perforations will be symmetrical with respect to the seam 20. Note that the perforations may be formed as dots, as a series of colinear lines, or as a series of lines extending in parallel directions (e.g., a "ladder" or a "stair-step" configuration). Alternatively, the perforations may be circles, ellipses, semi-circles, etc. The shape and orientation of perforations are selected to tend to facilitate opening without decreasing bursting strength significantly, i.e., below an acceptable level. In particular, the shape and orientation of perforations may be varied to tend to reduce their interference with circumferential forces depending upon the compression direction of the articles within the bag and the strength of a given perforation array in that direction. For example, circular or elliptical perforations distribute circumferential forces and minimize stress points that would occur with a conventional line of slits. As another example, linear perforation slits extending in a direction parallel to circumferential forces, but arranged to delineate a frangible portion extending in a direction perpendicular to circumferential forces, will not decrease significantly resistance to the compression forces, but may result in a portion that is sufficiently frangible.

By way of specific examples with respect to the drawings, in FIG. 1, frangible portion 30 may comprise a single line of co-linear perforations, or a double line of perforations, as shown. The line of perforations 31 may comprise a plurality of elliptical perforations with their longitudinal axes colinear and parallel with the direction A. These perforations may also be circular. The frangible portion 38 on end panel 16 may comprise a line or lines of perforations similar to those described above with respect to frangible portion 30. The notch-shaped frangible section 40 may comprise one or more angled lines of colinear line perforations, as shown. Alternatively, the angled frangible portion may comprise a plurality of "stair-step" linear perforations having parallel horizontal or angled axes. The angled perforations may be circular or elliptical with the axes of the ellipses disposed either parallel to, angled with respect to, or perpendicular to direction A. In FIG. 3, frangible portion 50 may comprise one or more lines of perforations which may be colinear in the vertical direction, as shown. Alternatively, the line or lines of perforations may be "ladder"-shaped wherein the linear perforations are parallel but spaced apart from each other. Each linear perforation opening may comprise two or more linear openings angled with respect to each other (i.e., "herring bone"). The above-discussed configurations of perforations may be utilized for any of the frangible portions discussed above including the frangible portions of FIGS. 5, 6, 7, 8, 9, 10, 11, 12, 13, and 14. Again, the choice of the type and pattern of perforations may be varied depending upon the type of bag to be produced and the articles which are to be contained in the bag.

In the preferred forms of the present invention, each of the bags is a single layer bag. However, the bag may be a "duplex" bag in which each of the front, rear, left, and right panels comprises two layers of plastic bonded together at their peripheral portions. Typically, the exterior or outer bag contains printing, bar codes, advertisements, etc., while the inner bag is transparent.

Many alternatives are available in order to successfully practice the present invention. For example, each bag may comprise a single layer of plastic or two or more layers of plastic. The layers of plastic may be homogeneous, or one of the plastic layers may comprise a different form or dimension of plastic. Additionally, each bag may comprise a combination of polymeric plastics, rubberized materials, paper, etc., so long as the materials are susceptible to high speed manufacturing processes. In addition, while various linear, notch-shaped, and semicircular arrays of perforations or frangible portions have been described above, the particular form of each array of perforations or frangible portions may be varied without departing from the functional aspects of the invention described herein. Furthermore, any of the bags according to the present invention may include a resealable closure such as a tongue-in-groove structure known to the art as Zip-lock®, or an adhesive to allow the bag to be reused. In this instance, the resealable closure would preferably be formed astride one or more of the frangible portions.

Bags according to the present invention may include a plastic loop handle, a plastic handle extending longitudinally over the bag from the left end panel to the right end panel, or may be without a handle. Various combinations or subcombinations of the embodiments described above may be embodied in a single bag depending upon the end use for which the bag is designed. While the herein-described easy opening bags are intended for use with compressed articles such as disposable diapers, the advantageous opening and manufacturing features described above make the bag according to the present invention useful for noncompressed articles as well.

Thus, what has been described above is a flexible plastic bag which is easy to manufacture, stable during transportation, storage, and display, and is easy to open. Highly compressed articles may be transported in the bag, yet the consumer will find the bag easy to open and easy to use. The present invention also includes the method of making such a bag.

While the present invention has been described with what are presently considered to be the most practical and preferred embodiments and methods, the invention is not limited to the disclosed embodiments or processes.

What is claimed is:

1. An easy opening plastic bag comprising:

a front panel;

a rear panel;

left and right end panels coupled to the front and rear panels;

a gusset formed at a top of the bag and coupled to the front and rear panels; and a first frangible line disposed near a top of the front panel;

a second frangible line disposed near a top of the rear panel;

a connecting frangible line connecting said first and second frangible lines, the first, second, and connecting frangible lines lying substantially in a plane and allowing a portion of the bag to rotate away from the remainder of the bag about an axis parallel to said plane; and a third frangible line extending substantially perpendicular to said plane and intersecting at least one of said first, second, and connecting frangible lines.

2. A bag according to claim 1, wherein said third frangible line comprises a curvilinear frangible line connected to one of said first and second frangible lines.

3. A bag according to claim 1, wherein each said first, second, and third frangible lines comprises a line of perforations.

4. A bag according to claim 1, wherein said first frangible line extends from a top of said front panel to a point at least halfway down said front panel, and wherein said second frangible line extends from a top of said rear panel to a point at least halfway down said rear panel.

5. A bag according to claim 1, further comprising a third frangible line disposed in said front panel and substantially parallel to said first frangible line, and wherein said first and fourth frangible lines are spaced apart by a distance which is greater than a distance from a side edge of said front panel to the first frangible line.

6. A bag according to claim 1, wherein said first, second and connecting frangible lines comprise a single line of perforations wherein at least one of the shape and orientation of the perforation is varied to increase their resistance to circumferential forces within the bag.

7. An easy opening plastic bag for compressed articles, comprising, a front panel;

a rear panel;

left and right end panels coupled to the front and rear panels;

a gusset formed at a top of the bag and coupled to the front and rear panels; and first and second substantially vertical frangible lines respectively disposed in said front and rear panels but not traversing said front and rear panels, to minimize premature tearing caused by circumferential forces created in the bag by the compressed articles, a connecting frangible line connecting the first and second frangible lines so that the bag may be easily opened.

8. A bag according to claim 7, wherein said first frangible line extends from a top of said front panel to a point at least halfway down said front panel, and wherein said second frangible line extends from a top of said rear panel to a point at least halfway said rear panel.

9. A bag according to claim 7, further comprising a third frangible line disposed in said front panel and spaced apart from said first frangible line, and a fourth frangible line disposed in said rear panel and spaced apart from said second frangible line.

10. A bag according to claim 9, further comprising a fifth frangible line disposed in said front panel and connecting said first and third frangible lines, and a sixth frangible line disposed in said rear panel and connecting said second and fourth frangible lines.

11. A bag according to claim 10, wherein the distance between the first and third frangible lines is greater than a distance from a side edge of said front panel to the closest one of said first and third frangible lines.

12. A bag according to claim 7, comprising a third frangible line disposed in said gusset and, wherein the first, second, and connecting frangible lines comprise a single line of perforations wherein at least one of the shape and orientation of the perforations is varied to increase their resistance to circumferential forces within the bag.

13. An easy opening bag for compressed articles comprising, a front panel;

a rear panel;

left and right end panels coupled to the front and rear panels;

a gusset formed at a top of the bag and coupled to the front and rear panels; and a frangible line disposed in said front panel, said gusset, and said rear panel but not traversing said front or rear panel to minimize premature tearing caused by circumferential forces.

14. A bag according to claim 13, wherein said frangible line extends at least halfway down the front and rear panels.

15. A bag according to claim 13, further comprising a second frangible line spaced apart from said frangible line and disposed in said front panel, said gusset, and said rear panel, and further comprising third and fourth frangible lines, respectively disposed in said front and rear panels and connecting together ends of said frangible and second frangible lines.

16. A bag according to claim 15, wherein a distance between said frangible line and said second frangible line is greater than a distance from a side edge of said front panel to the closest one of the frangible and second frangible lines.

17. A bag according to claim 13, wherein said frangible line comprises a line of perforations, at least one of the shape and orientation of the perforations being varied to increase their resistance to circumferential forces within the bag.

18. A plastic bag comprising:

front and rear plastic panels;

left and right plastic panels joined to the front and rear panels;

a plastic gusset disposed at a top of the bag and coupled to the front, rear, left, and right panels;

a plastic handle coupled to the front and rear panels and extending across the gusset, the handle including front and rear handle skirts extending respectively across top portions of the front and rear panels between the respective two upper corners of the bag;

a first line of perforations extending up the front panel, across the front handle skirt, across the gusset, across the rear handle skirt, and down the rear panel; and a second line of perforations spaced apart from said first line of perforations and extending up the front panel, across the front handle skirt, across the gusset, across the rear handle skirt, and down the rear panel.

19. A bag according to claim 18, further comprising a third line of perforations disposed in said front panel and connecting said first and second lines of perforations, and a fourth line of perforations disposed in said rear panel and connecting said first and second lines of perforations.

20. A bag according to claims 19, wherein said third and fourth lines of perforations are curvilinear arrays of perforations.

21. A bag according to claim 18, wherein said first line of perforations extends from a top of said front panel to a point at least halfway down said front panel, and wherein said second line of perforations extends from a top of said rear panel to a point at least halfway down said rear panel.

22. A bag according to claim 18, wherein said first and second lines of perforations are spaced apart by a distance which is greater than a distance from a side edge of said front panel to the closest one of said first and second lines of perforations.

* * * * *